US007429098B2

(12) United States Patent
Murakami et al.

(10) Patent No.: US 7,429,098 B2
(45) Date of Patent: Sep. 30, 2008

(54) LIQUID DROPLET DISCHARGE UNIT AND LIQUID DROPLET DISCHARGE APPARATUS

(75) Inventors: Kohei Murakami, Ebina (JP); Kishiharu Itazu, Ebina (JP); Masashi Hiratsuka, Ebina (JP); Atsushi Murakami, Ebina (JP); Katsushi Amarume, Ebina (JP); Naoki Morita, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 353 days.

(21) Appl. No.: 11/283,001

(22) Filed: Nov. 18, 2005

(65) Prior Publication Data

US 2006/0284914 A1 Dec. 21, 2006

(30) Foreign Application Priority Data

Jun. 21, 2005 (JP) ..... 2005-180588

(51) Int. Cl.
*B41J 2/04* (2006.01)
*B41J 2/175* (2006.01)

(52) U.S. Cl. ..... 347/54; 347/85

(58) Field of Classification Search ..... 347/18, 347/54, 67, 72, 223, 85; 165/104.33
See application file for complete search history.

(56) References Cited

U.S. PATENT DOCUMENTS 5,231,423 A * 7/1993 Wataya et al. ..... 347/18
5,451,989 A * 9/1995 Kadowaki et al. ..... 347/18
5,486,849 A * 1/1996 Miura et al. ..... 347/18
5,512,924 A * 4/1996 Takada et al. ..... 347/18
6,113,212 A * 9/2000 Ng ..... 347/18
2005/0062806 A1 * 3/2005 Terakura et al. ..... 347/72

* cited by examiner

*Primary Examiner*—Anh T. N. Vo
(74) *Attorney, Agent, or Firm*—Fildes & Outland, P.C.

(57) ABSTRACT

A liquid droplet discharge unit for discharging liquid droplets from nozzles is disclosed, and this liquid droplet discharge unit is constructed in such a way that plural nozzles are communicated with plural pressure chambers in which liquid is filled, the volumes of the respective pressure chambers are changed by plural drive elements to cause liquid droplets to be discharged from the respective nozzles. Further, one heat pipe, which is in thermal communication with the drive elements and moves heat to one end in the axial direction, is provided. A liquid droplet discharge apparatus equipped with such a liquid droplet discharge unit is also disclosed.

17 Claims, 20 Drawing Sheets

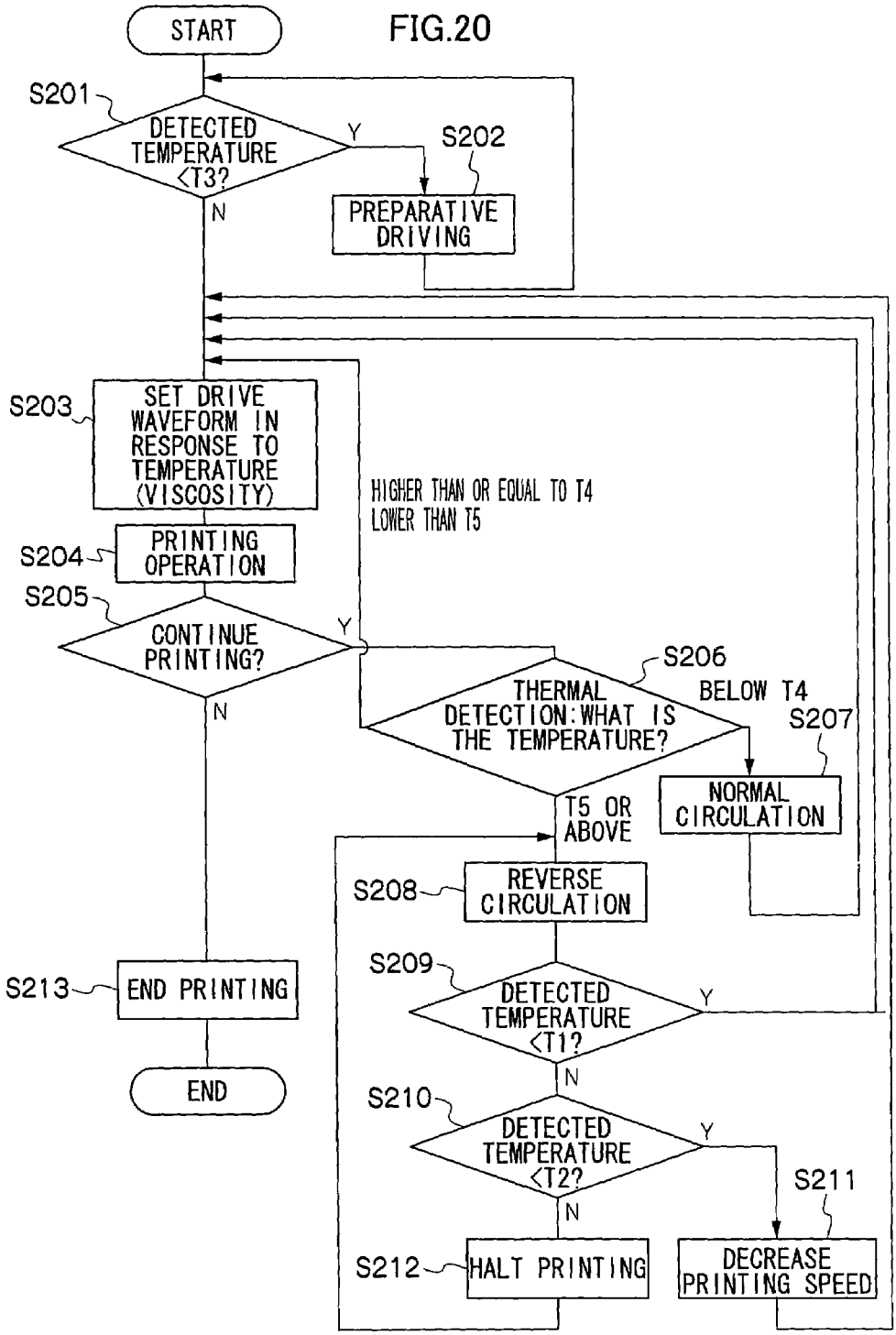
START
FIG.20
S201
DETECTED TEMPERATURE <T3?
Y
N
S202
PREPARATIVE DRIVING
S203
SET DRIVE WAVEFORM IN RESPONSE TO TEMPERATURE (VISCOSITY)
HIGHER THAN OR EQUAL TO T4 LOWER THAN T5
S204
PRINTING OPERATION
S205
CONTINUE PRINTING?
Y
N
S206
THERMAL DETECTION: WHAT IS THE TEMPERATURE?
BELOW T4
S207
NORMAL CIRCULATION
T5 OR ABOVE
S208
REVERSE CIRCULATION
S209
DETECTED TEMPERATURE <T1?
Y
N
S210
DETECTED TEMPERATURE <T2?
Y
N
S211
DECREASE PRINTING SPEED
S212
HALT PRINTING
S213
END PRINTING
END

LIQUID DROPLET DISCHARGE UNIT AND LIQUID DROPLET DISCHARGE APPARATUS

CROSS-REFERENCE TO RELATED APPLICATION

This application claims priority under 35 USC 119 from Japanese Patent Application No. 2005-180588, the disclosure of which is incorporated by reference herein.

BACKGROUND OF THE INVENTION

1. Field of the Invention

The present invention relates to a liquid droplet discharge unit for discharging droplets from a nozzle and a liquid droplet discharge apparatus provided with the droplet discharge unit.

2. Description of the Related Art

In a liquid droplet discharge unit such as an ink jet recording head unit which discharges ink droplets from a nozzle onto a sheet, a drive section such as a piezoelectric actuator changes the volume of a pressure chamber to cause liquid filled in the pressure chamber to be discharged as droplets from a nozzle which is communicated with the pressure chamber. Since these drive sections are provided corresponding to each pressure chamber, in a case of an elongated droplet discharge head whose width is equal to or larger than that of a sheet, the number thereof becomes extremely large. Meanwhile, with recent demands to increase print speeds, the driving speed of the drive sections has been speeded up. Thus, the amount of heat of a drive element which transmits an electrical signal to the drive sections to drive the drive sections increases so that damage of the drive element by heat occurs easily. Because of this, various methods for quickly radiating heat away from the drive element have been devised in order to improve the reliability of the drive element (for example, see Japanese Patent Application Laid-Open No. 2003-311953). Various methods for quickly radiating away heat of a liquid droplet discharge head itself also have been devised (for example, see Japanese Patent Nos. 2723998 and 2732693).

Here, in the case of the elongated droplet discharge head, since it is difficult, in terms of mounting, to electrically connect plural drive sections with one drive element, the plural drive sections are divided into a plurality of portions, and one drive element is provided for each portion. Thus, as differences in the liquid droplet discharge amounts of the respective portions occur, so differences in the drive amounts of the respective portions occur, whereby differences in the amount of heat of the respective drive elements occur. Thus, there is a problem that differences in reliabilities of the respective drive elements occur.

SUMMARY OF THE INVENTION

The present invention has been made in consideration of the above circumstances.

A first aspect of the invention provides a liquid droplet discharge unit comprising: a plurality of nozzles; a plurality of pressure chambers in which liquid is filled, each being communicated with at least one of the plurality of nozzles; a plurality of drive sections each of which changes the volume of at least one of the plurality of pressure chambers to allow a liquid droplet to be discharged from the nozzle; a plurality of drive elements, each of which causes one of the plurality of drive sections to be driven; and a heat pipe which is in thermal communication with the plurality of drive elements, and moves heat to one end in an axial direction of the heat pipe.

A second aspect of the invention provides a liquid droplet discharge unit comprising: a plurality of nozzles; a plurality of pressure chambers in which liquid is filled, each being communicated with at least one of the plurality of nozzles; a plurality of drive sections each of which changes the volume of at least one of the plurality of pressure chambers to allow a liquid droplet to be discharged from the nozzle; a plurality of drive elements, each of which causes one of the plurality of drive sections to be driven; a heat pipe which is in thermal communication with the plurality of drive elements, and moves heat to one end in an axial direction of the heat pipe; a heat-receiving member which is in thermal communication with one end portion in the axial direction of the heat pipe, and receives heat from the heat pipe; a thermal detection section that detects the temperature of the heat-receiving member; a first control section that stops the drive of the drive section or reduces a speed when the temperature detected by the thermal detection section is at a predetermined temperature or higher; a tank that stores liquid; a liquid feed path which is in thermal communication with the heat-receiving member and which supplies liquid from the tank to the pressure chambers; and a second control section that switches a drive waveform of the drive section in response to the temperature detected by the thermal detection section.

A third aspect of the invention provides a liquid droplet discharge apparatus comprising a liquid droplet discharge unit and a transport section, the liquid droplet discharge unit comprising: a plurality of nozzles; a plurality of pressure chambers in which liquid is filled, each being communicated with at least one of the plurality of nozzles; a plurality of drive sections each of which changes the volume of at least one of the plurality of pressure chambers to allow a liquid droplet to be discharged from the nozzle; a plurality of drive elements, each of which causes one of the plurality of drive sections to be driven; and a heat pipe which is in thermal communication with the plurality of drive elements to move heat to one end side of an axial direction; said transport section, which transports a sheet while the sheet is opposed to the nozzles.

Other aspects, features, and advantages of the present invention will become apparent from the following description taken in conjunction with the accompanying drawings.

BRIEF DESCRIPTION OF THE DRAWINGS

Preferred embodiments of the present invention will be described in detail based on the following figures, in which:

FIG. 20 is a flow chart for explaining a control method of the ink jet recording head unit of FIGS. 18-19.

DETAILED DESCRIPTION OF THE INVENTION

A first embodiment of the invention will be described below with reference to the drawings.

Figure 1:
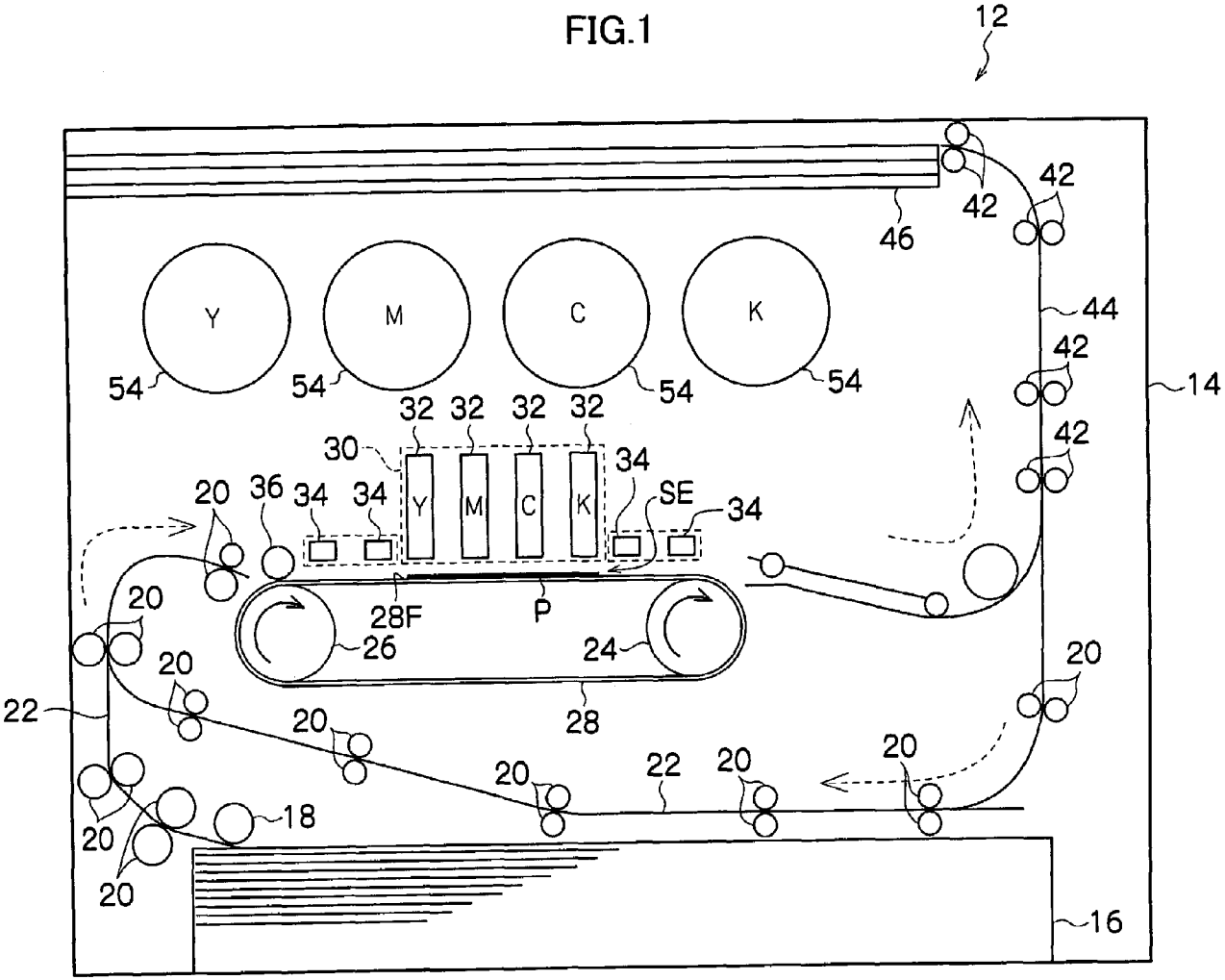
FIG. 1 is a schematic view showing an ink jet recording apparatus embodying the present invention.

An ink jet recording apparatus 12 embodying the invention is shown in FIG. 1. A paper feed tray 16 is provided at a lower portion inside a housing 14 of the ink jet recording apparatus 12, and paper P, stacked in the paper feed tray 16, can be taken one by one by a pick up roll 18. The taken paper P is transported by plural pairs of transport rollers 20 constituting a predetermined transport path 22.

An endless transport belt 28 tensioned around a drive roll 24 and a driven roll 26 is disposed above the paper feed tray 16. A recording head array 30 is disposed above the transport belt 28, and faces a flat portion 28F of the transport belt 28. This area is a discharge area SE where ink droplets are discharged from the recording head array 30. The paper P transported along the transport path 22 is supported by the transport belt 28 to reach this discharge area SE, and ink droplets from the recording head array 30 adhere to the paper P in accordance with image information in a state in which the paper P faces the recording head array 30.

In this embodiment of the present invention, the recording head array 30 has an elongated shape whose effective recording region has a width equal to that of the paper P or greater (size in the direction perpendicular to a transport direction), and four ink jet recording heads (hereinafter referred to as recording heads) 32, corresponding to respective four colors of yellow (Y), magenta (M), cyan (C), and black (K), are disposed along the transport direction, enabling a full color image to be recorded.

Figure 4:
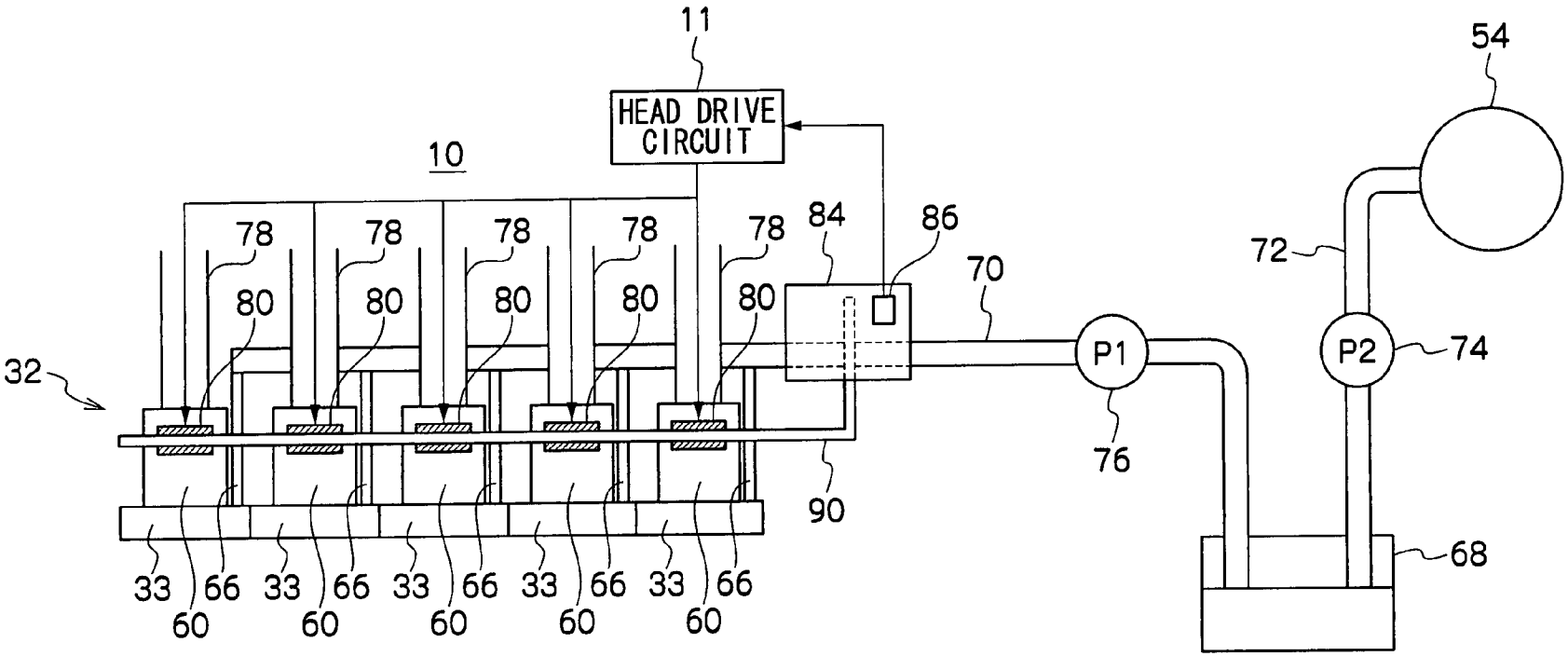
FIG. 4 is a view showing an outline of an ink jet recording head unit of a first embodiment of the invention.

The respective recording heads 32 are controlled by a head drive circuit 11 (see FIG. 4). The head drive circuit 11 is, for example, constructed such that it determines a discharge timing of ink droplets and which ink discharge ports (nozzles) should be employed, in accordance with image information, and to send a drive signal to the recording heads 32.

The recording head array 30 may be immovable in the direction perpendicular to the transport direction, but if it is constructed so as to be movable as the need arises, for multipass image recording by, a higher resolution image can be recorded, and problems with the recording heads 32 can be prevented from being reflected in the recording results.

Figure 2:
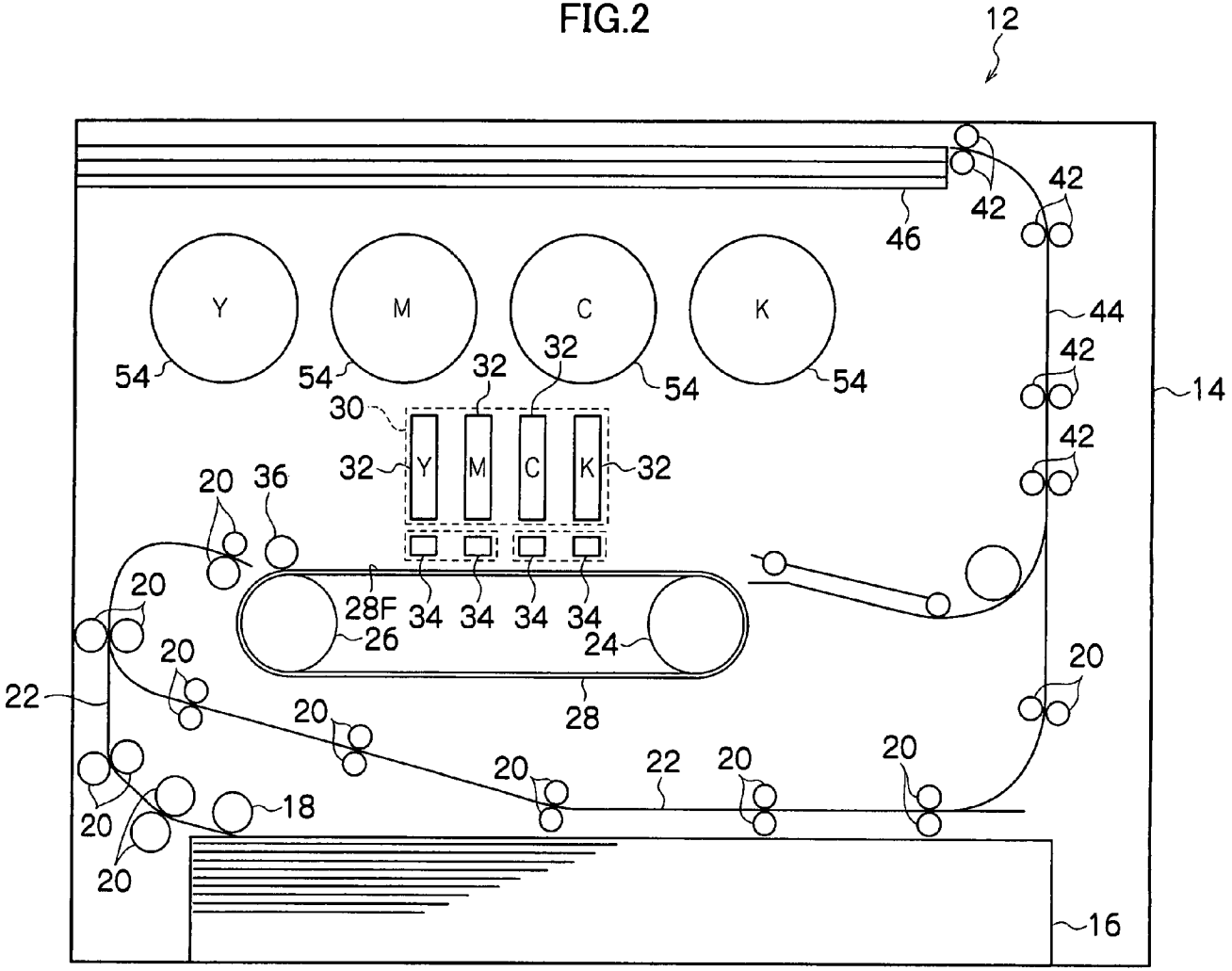
FIG. 2 is a schematic view showing the ink jet recording apparatus shown in FIG. 1 in a maintenance mode of recording head units.

Four maintenance units 34 corresponding to the respective head units 32 are arranged at each side of the recording head array 30. As shown in FIG. 2, when maintenance is performed for the head units 32, the recording head array 30 moves in an upward direction, and the maintenance units 34 move into a gap formed between the recording head array 30 and the transport belt 28. In a state in which the maintenance units 34 face nozzle surfaces 32N (see FIG. 3), predetermined maintenance actions (suction, wiping, capping, and the like) are performed.

Figure 3:
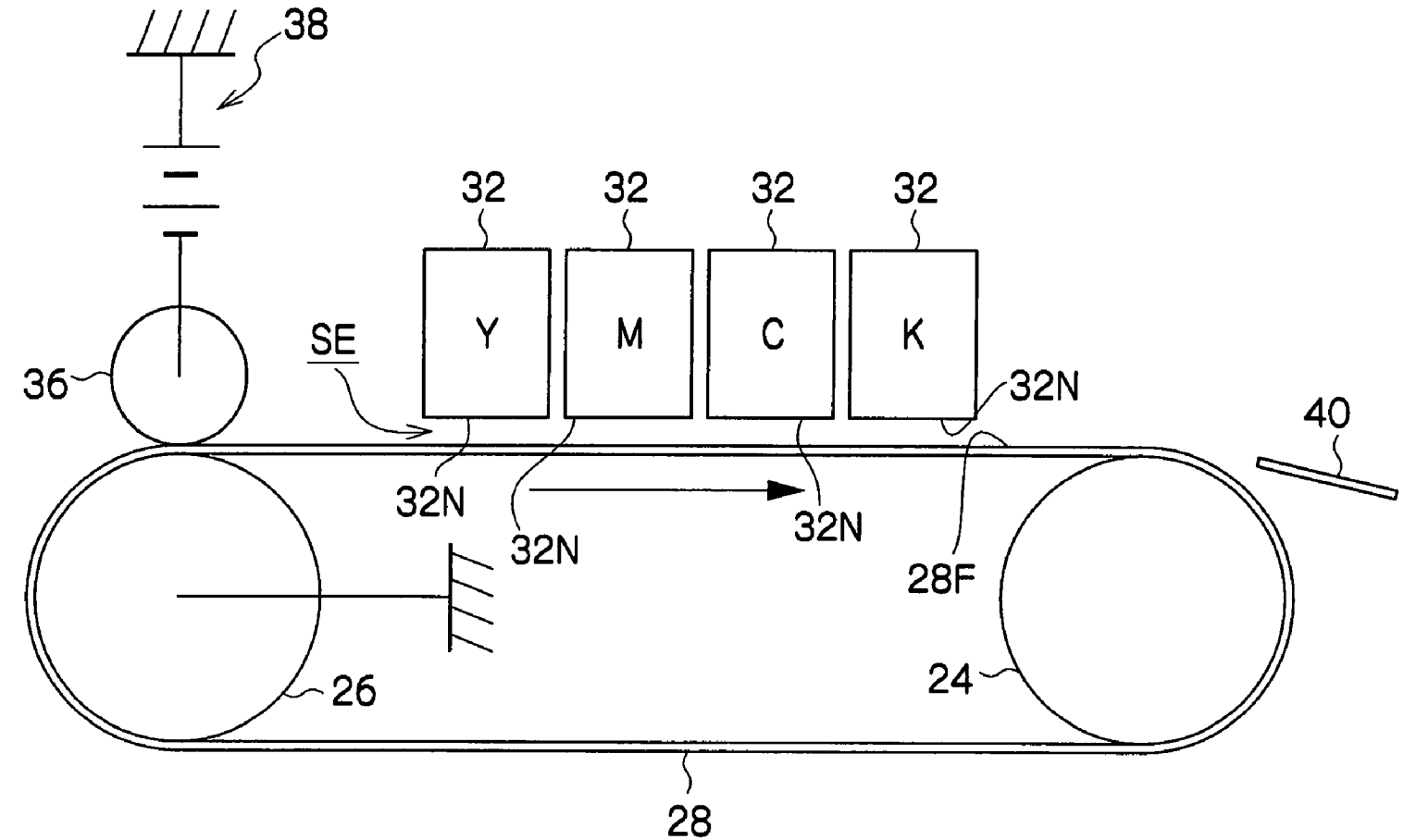
FIG. 3 is a view showing an outline of a printing section of an ink jet recording apparatus of an embodiment of the invention.

As shown in FIG. 3, a charging roll 36 to which a power source 38 is connected is disposed upstream of the recording head array 30. The charging roll 36 is rotated while the transport belt 28 and the paper P are sandwiched between it and the driven roll 26, and is allowed to be movable between a pressing position, at which the paper P is pressed to the transport belt 28, and a spaced position, spaced apart from the transport belt 28. At the pressing position, since a predetermined electric potential difference is formed between the charging roll 36 and the grounded driven roll 26, it is possible to give electrical charge to the paper P so that the paper P can be electrostatically attracted and attached to the conveyor belt 28.

A separation plate 40 is disposed downstream of the recording head array 30 to separate the paper P from the transport belt 28. The paper P which has been separated is transported by means of a plurality of discharge roller pairs 42 which form a discharge path 44 downstream of the separation plate 40 and is discharged into a catch tray 46 which is disposed in an upper portion of the housing 14.

Main ink tanks 54, storing respective color inks, are disposed over the recording head array 30. As shown in FIG. 4, each main ink tank 54 is coupled with an ink jet recording head unit (hereinafter referred to as head unit) 10 (FIG. 5) having a recording head 32.

The structure of the head unit 10 will be described below. Although one head unit 10 will be described here, other head units 10 have the same structure.

<First Embodiment>

Figure 5:
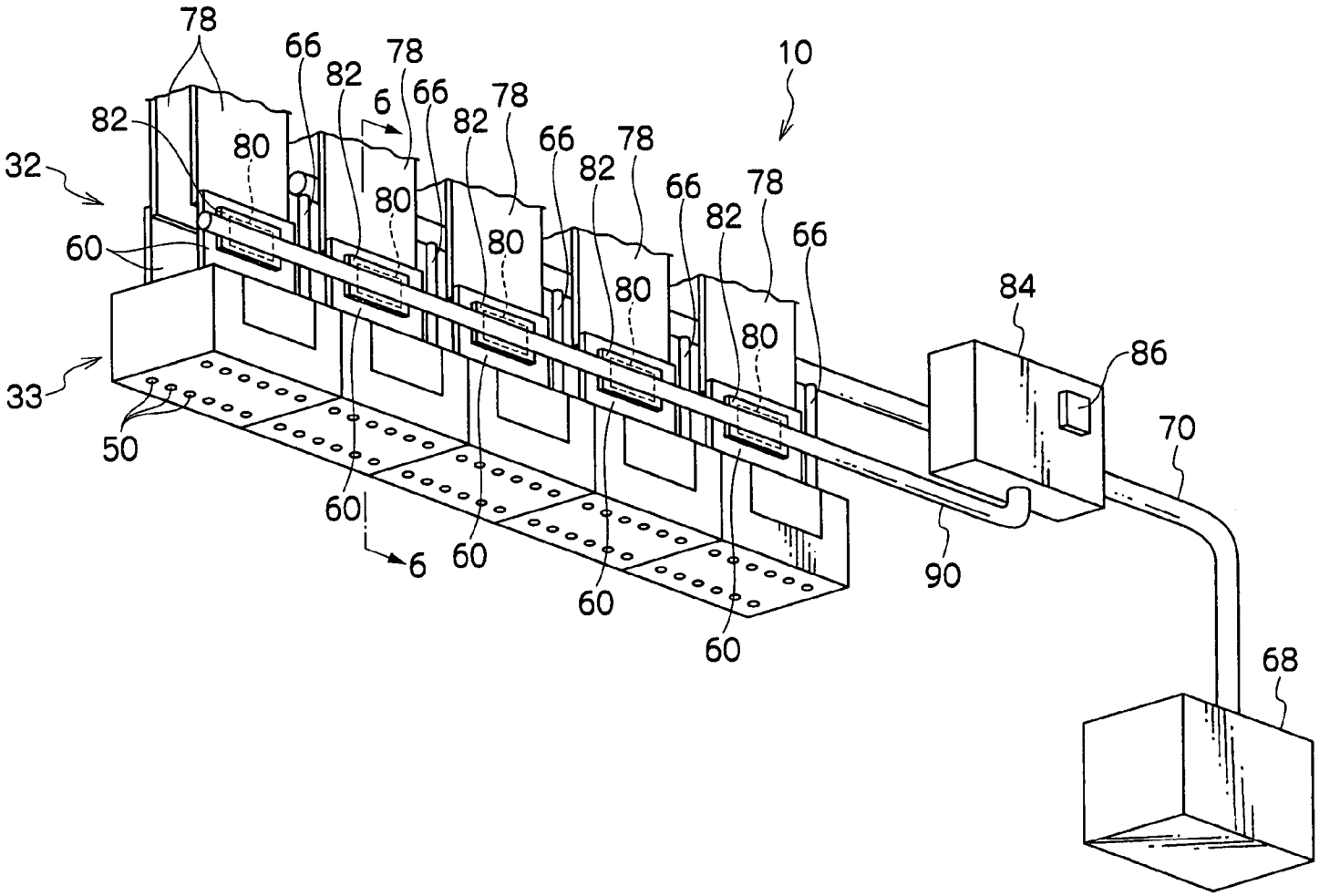
FIG. 5 is a perspective view showing the ink jet recording head unit of the first embodiment of the invention.

As shown in FIGS. 4 and 5, in the head unit 10, the recording head 32 is constructed in such a way that plural (for example, as shown in the drawing, five) recording head portions 33 whose width is shorter than that of the paper P are arranged in the width direction of the paper P. In each recording head portion 33, two rows of nozzles 50 are arranged along the width direction of the paper P.

Figure 6:
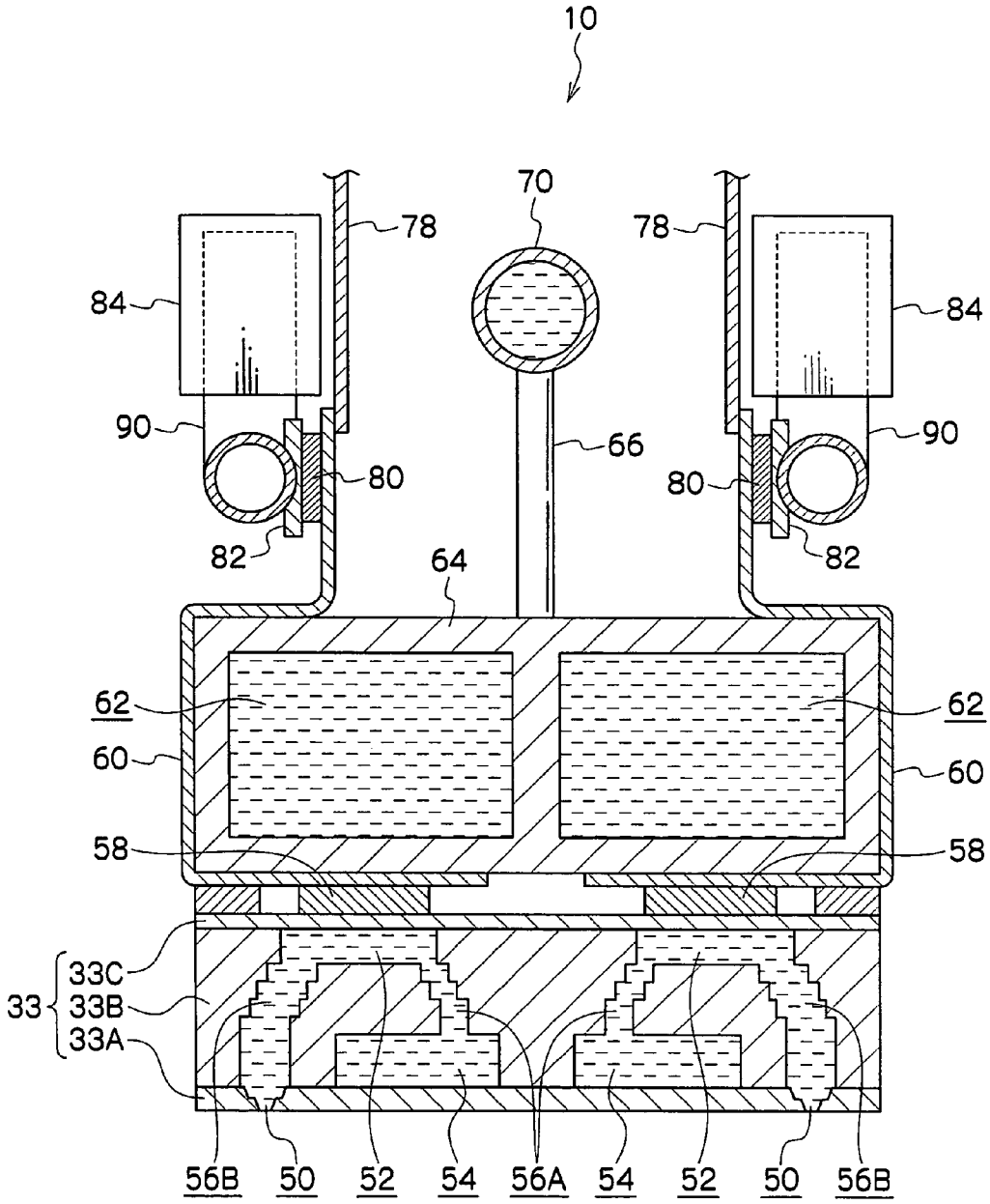
FIG. 6 is a cross-sectional view, taken along line 6-6 of FIG. 5.

As shown in FIG. 6, in each recording head portion 33, a nozzle plate 33A, a flow path plate 33B, a vibration plate 33C are stacked. Nozzles 50 are formed in the nozzle plate 33A. In the flow path plate 33B are formed a pressure chamber 52 in which a bonding surface between the flow path plate 33B and the vibration plate 33C is excavated, a manifold 54 in which a bonding surface between the flow path plate 33B and the nozzle plate 33A is excavated, an ink flow path 56A which interconnects the manifold 54 with the pressure chamber 52, and an ink flow path 56B which interconnects the pressure chamber 52 and the nozzle 50. The flow path plate 33B is formed by stacking a plurality of plates in which holes for forming the pressure chamber 52, the manifold 54, the ink flow paths 56A, 56B are bored.

Piezoelectric elements 58 are bonded to the back sides of the respective pressure chambers 52 of the vibration plate 33C. Wiring of a flexible printed circuit board 60 is soldered to the piezoelectric element 58. A block 64 in which an ink chamber 62 is formed is bonded to the upper surface of the vibration plate 33C, sandwiched by the flexible printed circuit board 60. The ink chamber 62 is communicated with the manifold 54 by means of an unillustrated ink flow path, and is communicated with an ink feed path branch 66 which is inserted into the block 64.

As shown in FIGS. 4-6, plural ink feed path branches 66, each of which is inserted into a recording head portion 33, branch from an ink feed path 70. One end portion of this ink feed path 70 is inserted into a sub ink tank 68. One end portion of an ink feed path 72 is inserted into the sub ink tank 68. The other end portion of this ink feed path 72 is inserted into the main ink tank 54. Pumps 74, 76 are provided on the ink feed paths 72, 70, respectively, and ink is fed from the main ink tank 54 to the sub ink tank 68 by the drive of the pump 74 so that ink is filled in the sub ink tank 68. Ink is fed from the sub ink tank 68 to the respective recording head portions 33 by the drive of the pump 76 so that ink is filled in the ink chambers 62, the manifolds 54, the pressure chambers 52, and the ink flow paths 56A, 56B.

The flexible printed circuit board 60 whose wiring is electrically connected to the piezoelectric element 58 is led from a lower side of the block 64 up to an upper side thereof via a side surface. In the flexible printed circuit board 60, plural wire lines each of which is electrically connected to a piezoelectric element 58 and plural terminals of a driver IC 80 are electrically and mechanically connected by solder. The plural lines of the flexible printed circuit board 60, which are soldered to plural components of the driver IC 80, are connected to the head drive circuit 11 by cable 78.

The head drive circuit 11 selects the driver IC 80 in accordance with image information and transmits a drive signal to the selected drive IC. The driver IC 80 which has received the drive signal selects the piezoelectric elements 58 in accordance with the drive signal and applies a voltage to the selected piezoelectric elements 58. The piezoelectric element 58 to which the voltage is applied bends to change the volume of the pressure chamber 52 to allow ink filled in the pressure chamber 52 to be discharged from the nozzle 50.

Here, one heat pipe 90 extends over the recording heads 32 in the longitudinal direction of the recording heads 32. Plural driver ICs 80 are in thermal communication to this heat pipe 90 by means of high thermal-transfer connection members 82, and heat of the driver ICs 80 is transferred to the heat pipe 90 via the connection members 82.

When the heat is transferred to the heat pipe 90, liquid inside the heat pipe 90 evaporates so that a vapor flow to a low temperature end in an axial direction (right side in FIG. 5) from the high temperature other end in the axial direction (left side in FIG. 5) is generated, and vapor condenses in the low temperature end side in the axial direction so that latent heat is radiated. Liquid produced by the condensation of the vapor returns to the other end in the axial direction. In this manner, the heat pipe 90 allows heat of the driver ICs 80 to move from the other end in the axial direction to the low temperature end.

Figure 7:
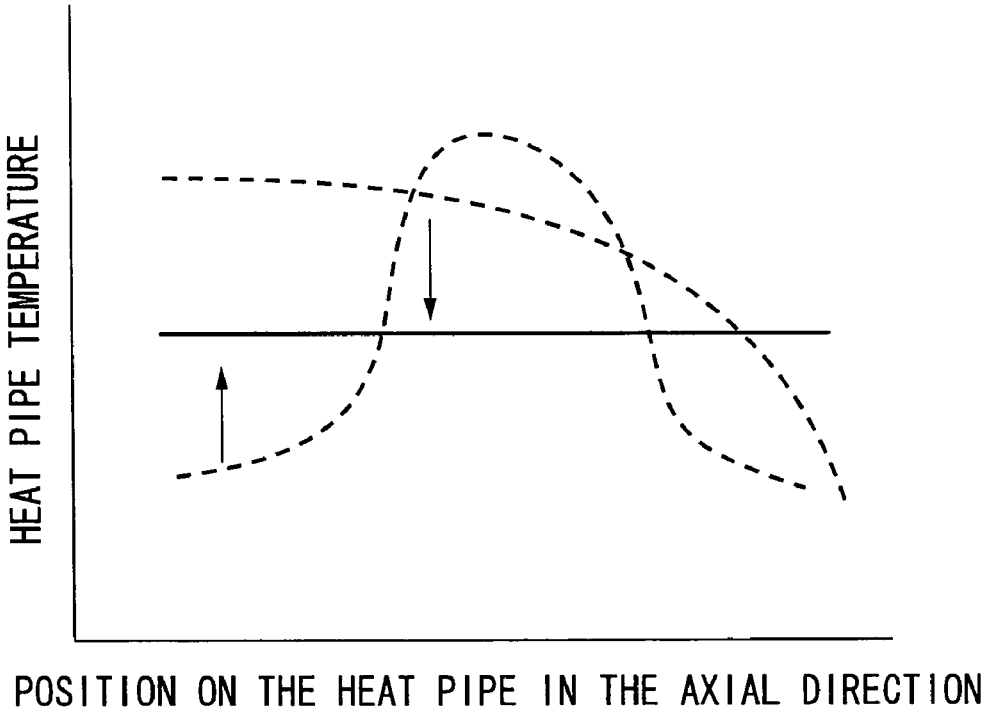
FIG. 7 is a graph showing distributions of the temperature of a heat pipe of the ink jet recording head unit of FIGS. 4-6.

Meanwhile, as shown in the graph of FIG. 7, there is a difference in ink discharge amounts of the respective nozzles 50, and the amount of heat of the driver IC 80 corresponding to a nozzle 50 whose ink discharge amount is large (shown by dashed lines) becomes greater than those of other driver ICs 80. In this case, in the heat pipe 90, since liquid is vaporized more actively at a position where an amount of heat received is larger than that at a position where an amount of heat received is smaller, so that heat of a driver IC 80 whose amount of heat is large is radiated more actively than the radiation of heat of other driver ICs 80, whereby the heat value of the driver IC 80 whose amount of heat is large is decreased to the amount of heat of other driver ICs 80 (shown by a solid line). That is, since the heat amounts of the plural driver ICs 80 are averaged out, differences in reliability regarding damage and quality deterioration of respective driver ICs 80 do not occur.

Since thermal management for all drive elements can be performed uniformly by constantly averaging the amounts of heat of plural drive elements, control becomes easy so that the cost of the control circuit can be reduced.

One end portion of the heat pipe 90 is bent approximately perpendicularly and is inserted into a heat-receiving block 84 formed of a material which has high heat radiation characteristics, such as aluminum or the like. Thus, heat discharge of the heat pipe 90 is facilitated.

A temperature sensor 86 is attached to the heat-receiving block 84, and the temperature of the heat-receiving block 84 is detected by this temperature sensor 86. The head drive circuit 11 performs control to stop printing or decrease printing speed in accordance with the temperature detected by the temperature sensor 86, to prevent damage and quality deterioration of the driver ICs.

Figure 8:
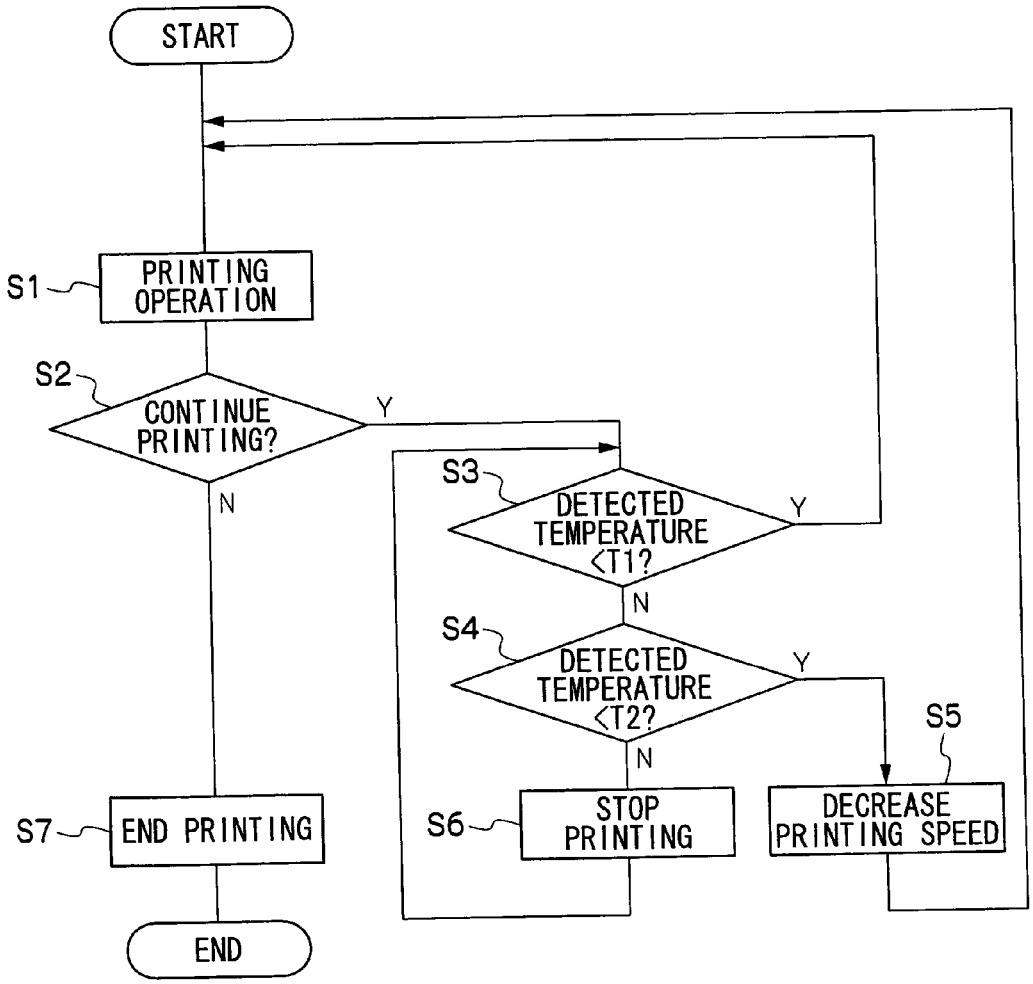
FIG. 8 is a flow chart for explaining a control method of the ink jet recording head unit of FIGS. 4-6.

The control, according to detection result of the temperature sensor 86, of the head drive circuit 11 will be described below with reference to the flow chart of FIG. 8.

Upon reception of a print job, a processing routine is started, and proceeds to step S1. In step S1, a drive signal is transmitted to the driver ICs 80, and the printing operation is executed. Then, in step S2, it is determined whether printing is continuing or not, and if the answer is yes, the process proceeds to step S3. If the answer is no, the process proceeds to step S7. In step S3, it is determined whether a temperature t of the heat-receiving block 84 detected by the temperature sensor 86 is lower than a predetermined temperature T1 or not, and if the answer is yes, the process returns to step S1 so that the printing operation is continued. If the answer is no, the process proceeds to step S4.

In step S4, it is determined whether the temperature t of the heat-receiving block 84 detected by the temperature sensor 86 is lower than a predetermined temperature T2 or not, and if the answer is yes, the process proceeds to step S5. If the answer is no, the process proceeds to step S6. In step S5, printing speed is decreased, and the process returns to step S1 so that printing operation is continued. In step S6, printing is stopped, and the process returns to step S3 so that the processing routine of steps S3-S6 is repeated. In step S7, transmission of the drive signal to the driver ICs 80 is stopped, and the printing operation is stopped to complete the processing routine.

The predetermined temperature T2 is a temperature at which there is a risk that the driver ICs 80 are damaged by their own heat, and the predetermined temperature T1 is a temperature which is lower than the predetermined temperature T2 but at which the temperature would increase to the predetermined temperature T2 in a short period of time if the printing operation is continued at the current printing speed.

That is, when the amount of heat of the driver ICs 80 increases to the extent that there is a risk that the driver ICs 80 are damaged, transmission of the drive signal from the driver ICs 80 to the piezoelectric elements 58 is stopped, and heat generation of the driver ICs 80 is stopped. Before the amount of heat of the driver ICs 80 increases to the extent that there is a risk that the driver ICs 80 are damaged, the driving speed of the piezoelectric element 58 is decreased so that the slope of an increase of the amount of heat generation of the driver ICs 80 is decreased.

Here, since the heat amounts of the all driver ICs 80 are averaged by the heat pipe 90, by uniformly managing the heat amounts of the all driver ICs 80 based on the temperature of the heat-receiving block 84, damage of the all driver ICs 80 can be prevented, so that the reliability can be ensured. Since all of the driver ICs 80 can be controlled uniformly, the head drive circuit 11 can be simplified, and the cost can be reduced.

Figure 9:
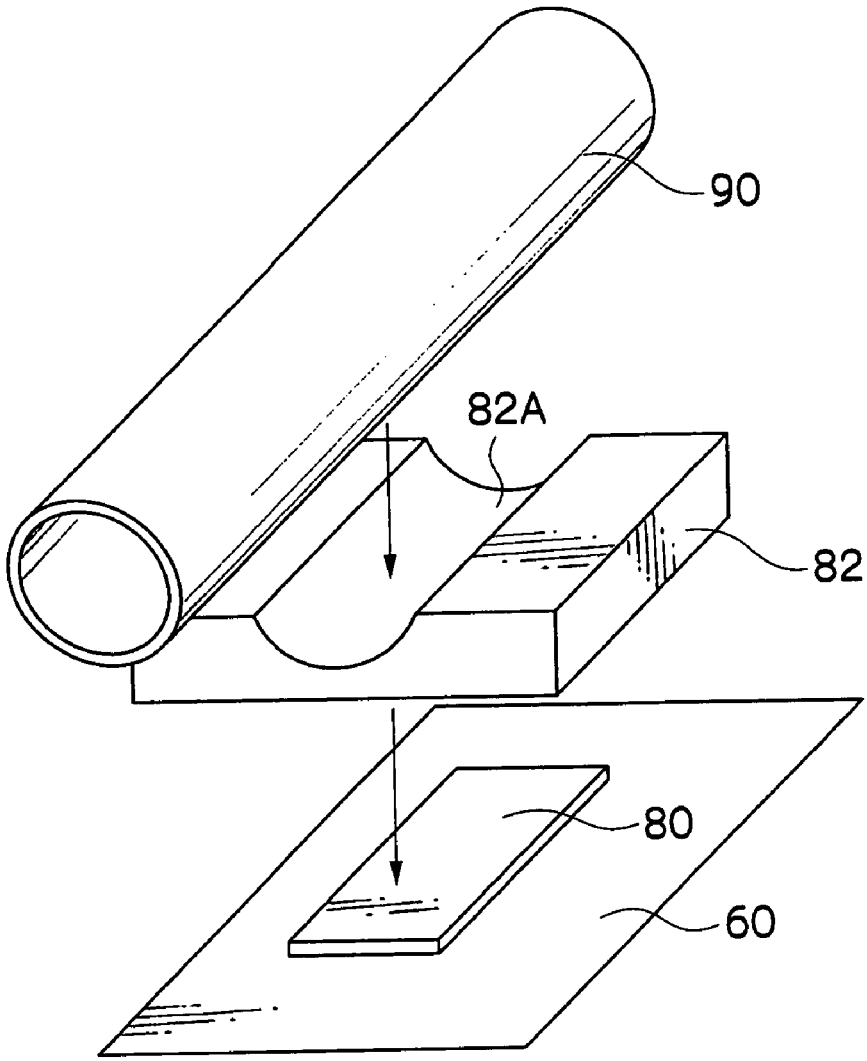
FIG. 9 is a perspective view showing a connection structure between the heat pipe and a driver IC in the ink jet recording head unit of FIGS. 4-6.

In the present embodiment, as shown in FIG. 9, the heat pipe 90 is fitted onto the connection member 82 in which a groove 82A which extends along a peripheral surface of the heat pipe 90 is formed to be fixed by a method such as bonding, and the connection member 82 is fixed on a surface of the driver IC 80 by a method such as bonding, so that the heat pipe 90 is coupled with the surface of the drive IC 80. However, other coupling structures may be applied.

Figure 10:
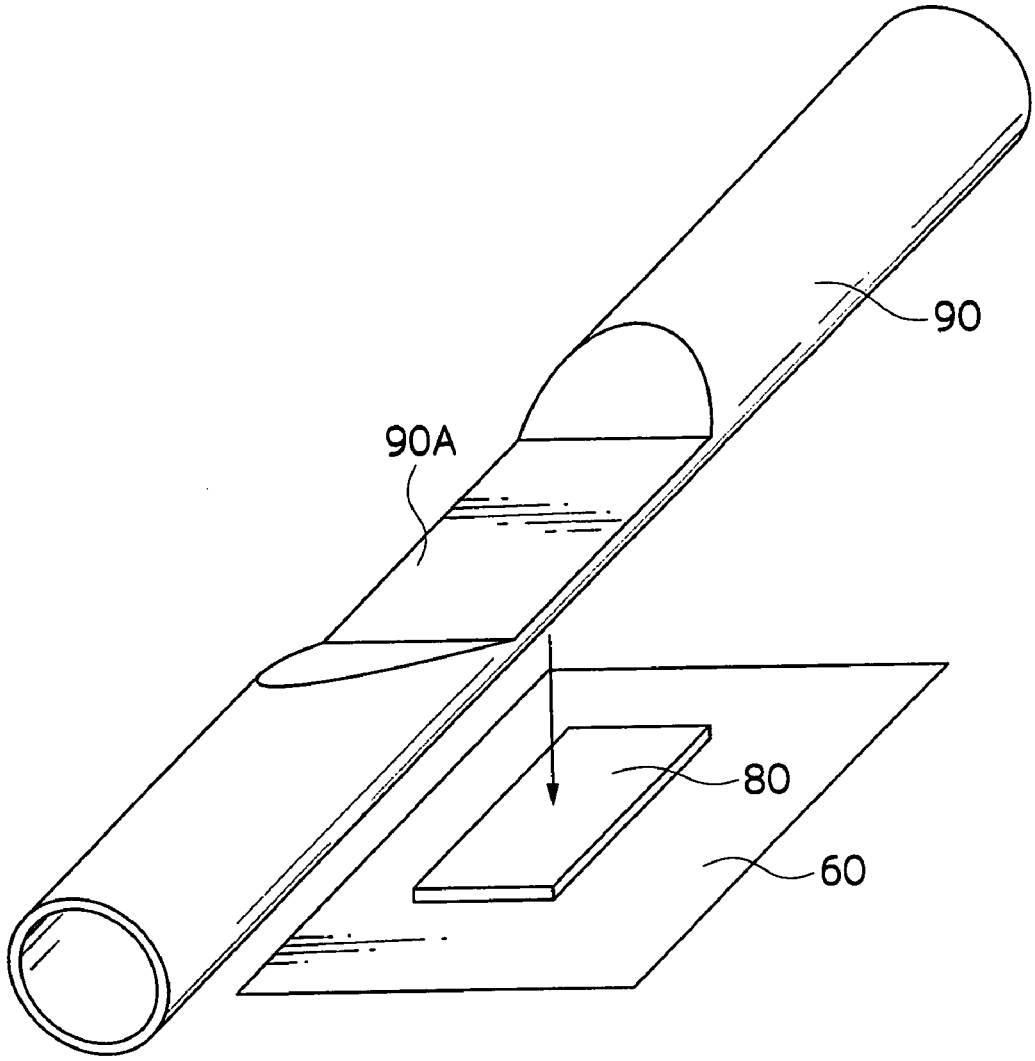
FIG. 10 is a perspective view showing an example of a modified connection structure between the heat pipe and the driver IC in the ink jet recording head unit of FIGS. 4-6.

For example, as shown in FIG. 10, a part of the heat pipe 90 may be formed into a flat shape, and this flat shape portion 90A may be coupled with the surface of the driver IC 80 by a method such as bonding. In this case, since the contact area between the heat pipe 90 and the driver IC 80 is larger than that in the coupling structure shown in FIG. 9, and since the heat pipe 90 and the driver IC 80 are directly in contact with each other, the heat radiation characteristics of the driver ICs 80 become higher compared to those in the coupling structure shown in FIG. 9.

Figure 11:
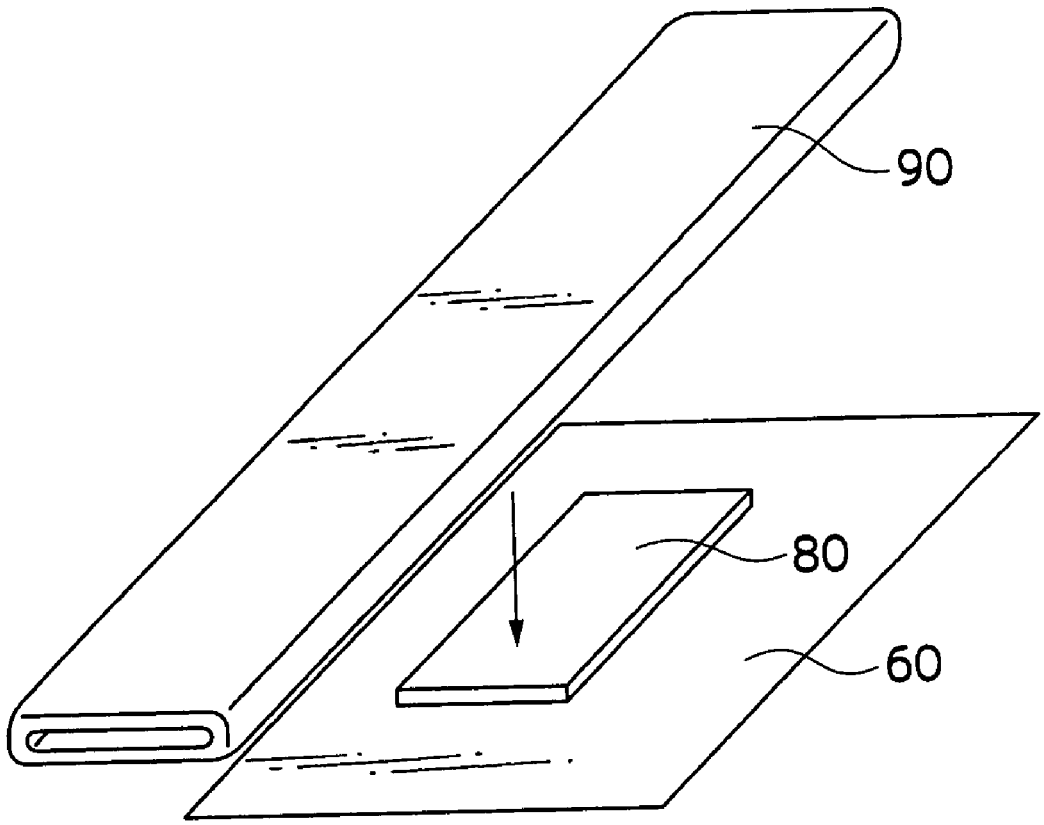
FIG. 11 is a perspective view showing another example a modified connection structure between the heat pipe and the driver IC in the ink jet recording head unit of FIGS. 4-6.

As shown in FIG. 11, the entire heat pipe 90 may be formed into a flat shape. The method for maintaining the coupling state between the heat pipe 90 and the driver IC 80 may be bonding or pressure contact. In the case of bonding, it is preferred that a glue which has a high thermal conductivity is employed, and in the case of pressure contact, it is preferred that an agent for enhancing the thermal conductivity, such as silicon oil which has a high thermal conductivity, lies between the contacting surfaces.

Figure 12:
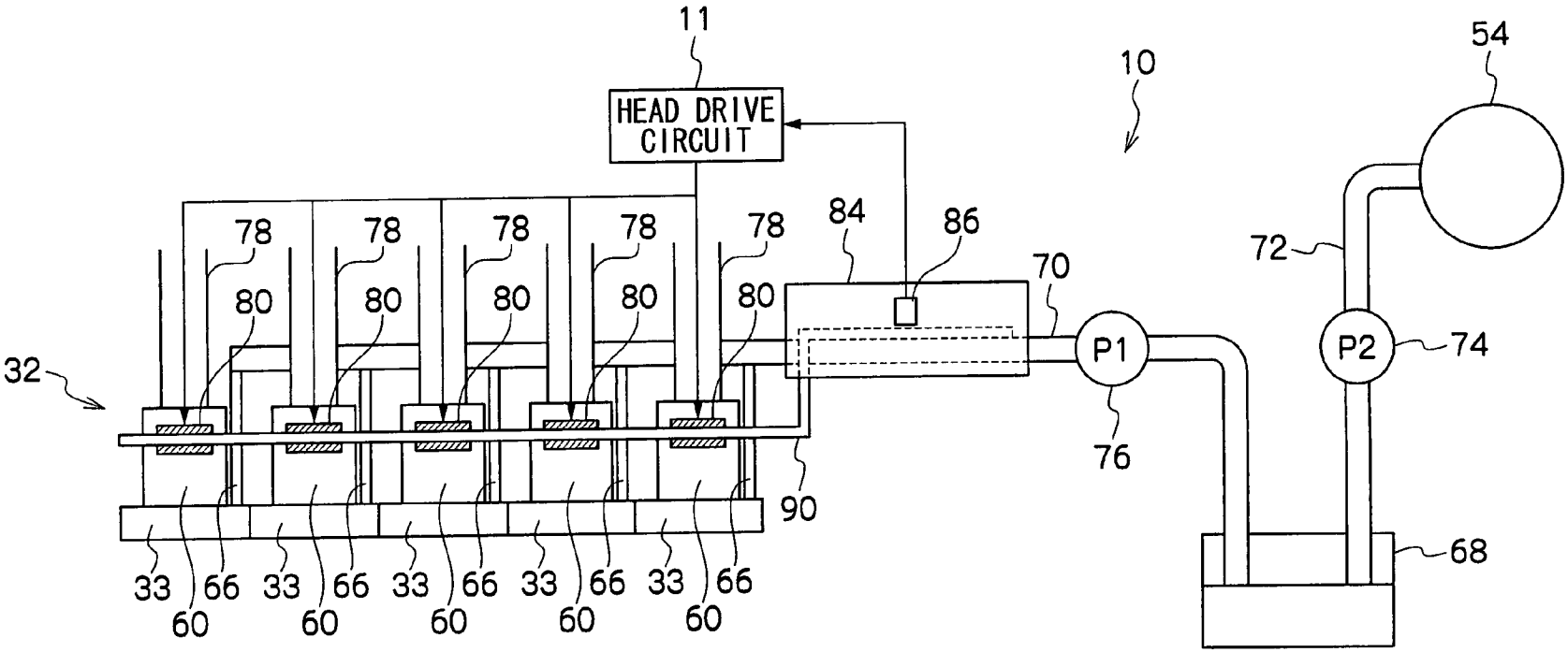
FIG. 12 is a view showing an outline of an example of a modified ink jet recording head unit of FIGS. 4-6.

As shown in FIGS. 4-6, in the present embodiment, the heat pipe 90 has an L-shape and the axial directional one end portion extending in the normal line of the paper P is thermal-transfer coupled with the heat-receiving block 84. However, as shown in FIG. 12, the one end portion of the heat pipe 90 may be further bent so as to extend in the width direction of the paper P so that it may be thermal-transfer coupled with the heat-receiving block 84. In this case, the contact area between the heat pipe 90 and the heat-receiving block 84 can be enlarged, so that the heat transfer speed of the heat pipe 90 can be increased.

<Second Embodiment>

Figure 13:
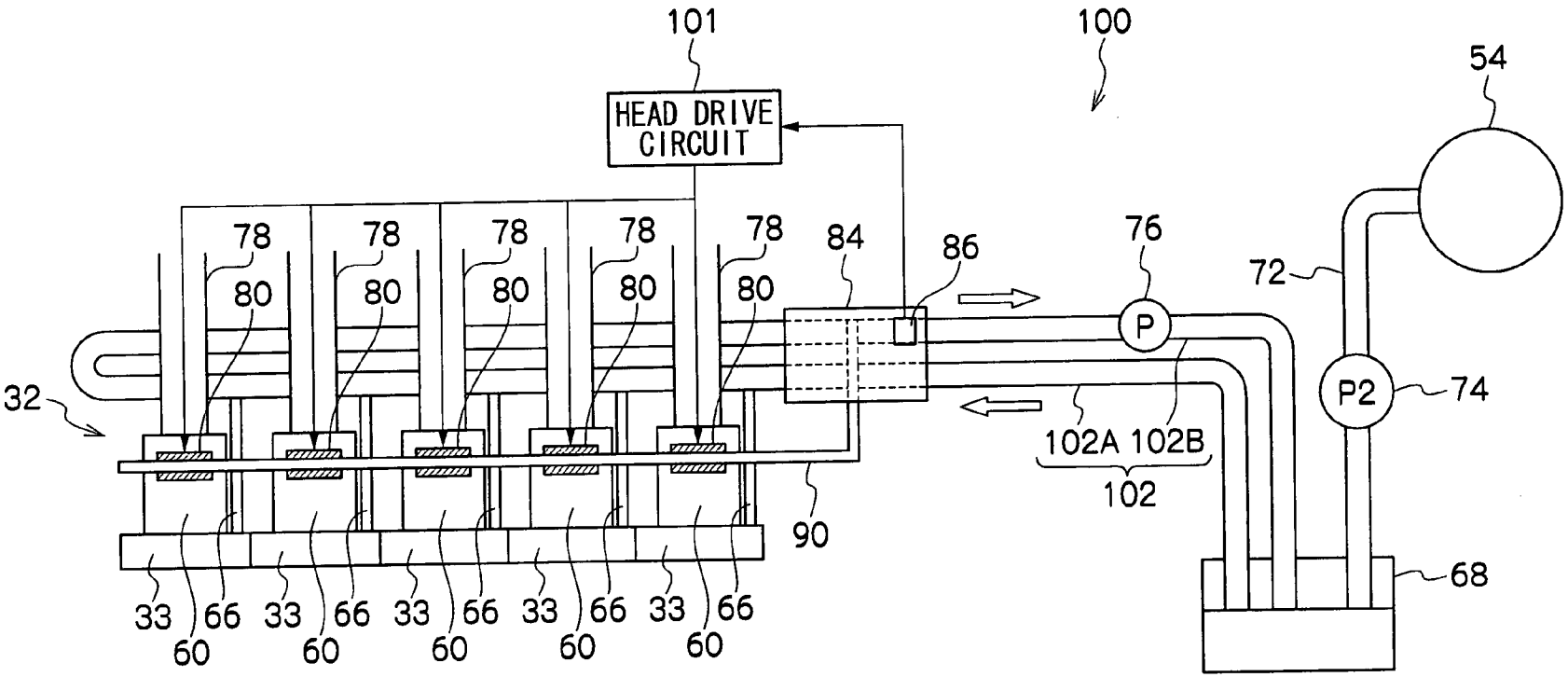
FIG. 13 is a view showing an outline of an ink jet recording head unit of a second embodiment of the invention.
Figure 14:
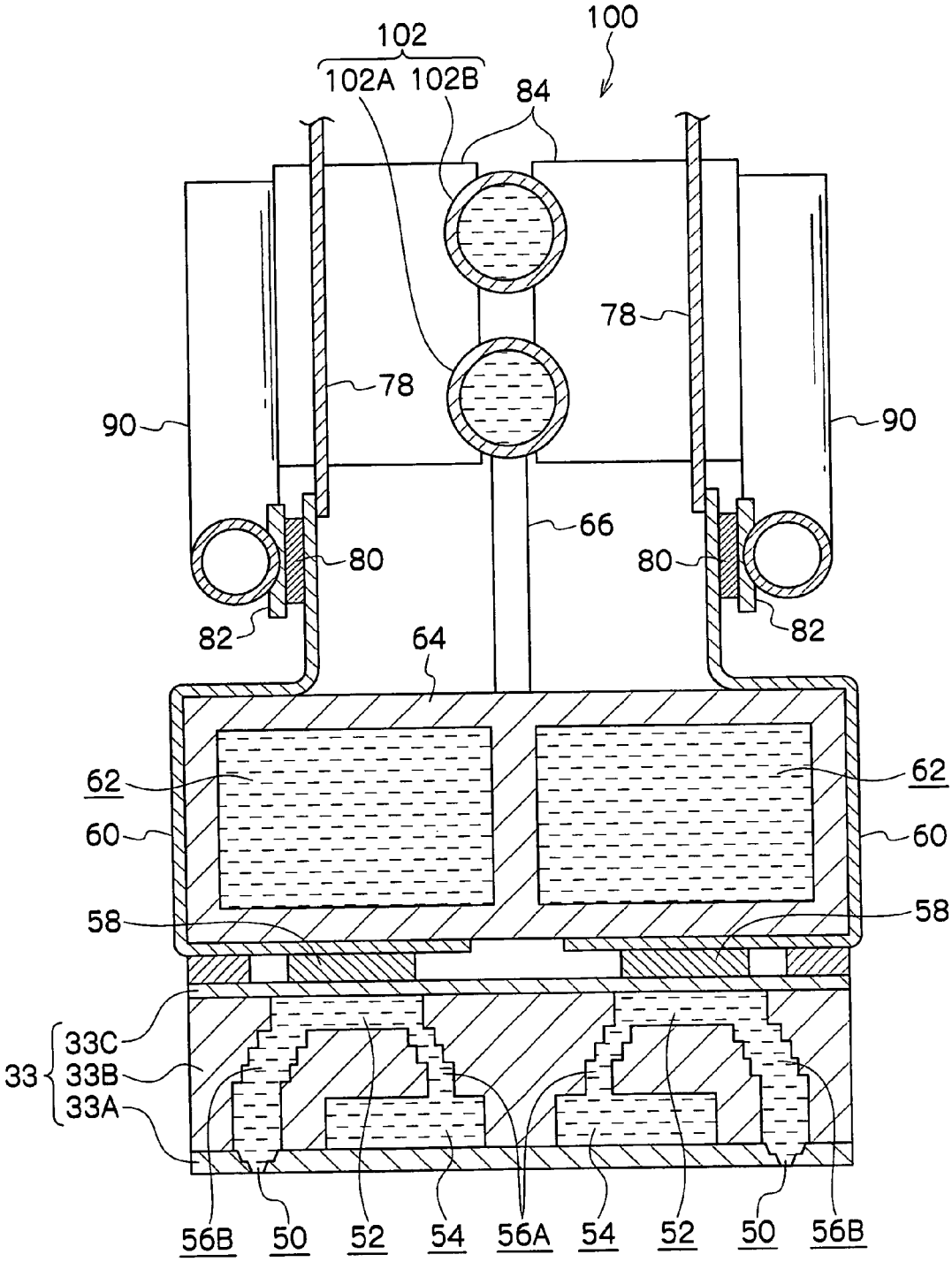
FIG. 14 is a cross-sectional view showing the ink jet recording head unit of the second embodiment of the invention.

As shown in FIGS. 13 and 14, in a head unit 100, an ink circulating path 102 circulating ink between the sub ink tank 68 and the recording heads 32 is provided. This ink circulating path 102 includes an ink feed path 102A supplying ink from the sub ink tank 68 to the recording heads 32 and an ink return flow path 102B for allowing ink to return from the recording heads 32 to the sub ink tank 68, and the heat-receiving block 84 is thermal-transfer coupled with the ink feed path 102A and the ink return flow path 102B. The ink circulating path 102 is formed of metal or resin which has a high thermal conductivity.

Thus, heat generated in the driver ICs 80 is transferred to the ink feed path 102A and the ink return flow path 102B through the heat pipe 90 and the heat-receiving block 84, so that ink flowing in the ink feed path 102A and the ink return flow path 102B is heated. Thus, since the viscosity of the ink is decreased, discharge of the ink is possible regardless of use conditions and environment.

By allowing ink to circulate between the sub ink tank 68 and the recording heads 32, the temperature of the entire ink in the ink circulating system becomes constant at a high level, and the viscosity becomes constant at a low level. Thus, ink can be stably discharged successively.

Since heat is transferred between the heat-receiving block 84 and the ink flowing in the ink circulating path 102 so that the temperatures of both portions are very close to each other, the temperature conforming to the temperature of the ink can be detected by detecting the temperature of the heat-receiving block 84 by means of the temperature sensor 86. Accordingly, the temperature (viscosity) of the ink can be controlled based on the temperature conforming to the temperature of the actual ink, and the accuracy of the temperature control of the ink can be improved.

Figure 15:
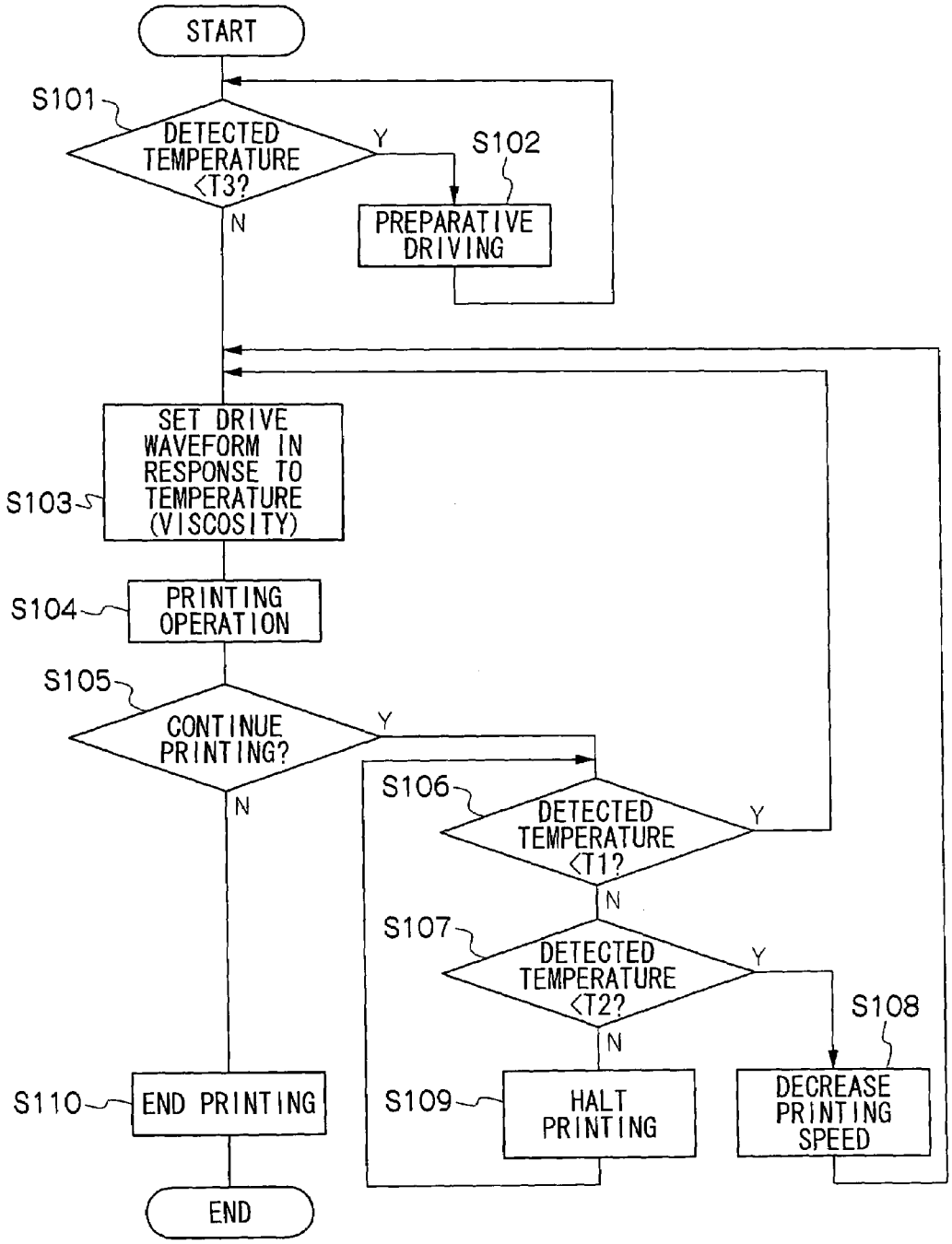
FIG. 15 is a flow chart for explaining a control method of the ink jet recording head unit of FIGS. 13-14.

Control in accordance with the detection result of the temperature sensor 86 of a head drive circuit 101 will be described below with reference to the flow chart of FIG. 15.

Upon receiving a print job, a processing routine is started, and proceeds to step S101. In step S101, it is determined whether the temperature t detected by the temperature sensor 86 is lower than a predetermined temperature T3 (<T1), and if the answer is yes, the process proceeds to step S102. If the answer is no, the process proceeds to step S103. In step S102, the drive signal is outputted from the driver ICs 80 to the piezoelectric elements 58, and the piezoelectric elements 58 are driven in preparation. Here, the preparative driving means driving in which the piezoelectric element 58 is changed in shape microscopically so that the meniscus of the nozzle 50 wobbles, to the extent that ink droplets are not allowed to be discharged from the nozzle 50. This is executed to restrict an increase of viscosity of the ink inside the nozzles 50. The ink of the ink circulating path 102 is heated by the generation of heat of the drive ICs 80 generated by the preparative driving, so that the viscosity of the ink is reduced. Here, since the heat generation of the driver ICs 80 is used, a specific heating means becomes unnecessary.

The predetermined temperature T3 is a temperature at which stable ink droplet discharge becomes possible, and when the temperature is lower than this temperature, the viscosity of the ink is increased so that ink droplet discharge becomes unstable. The process then returns to step S101.

Figure 16A:
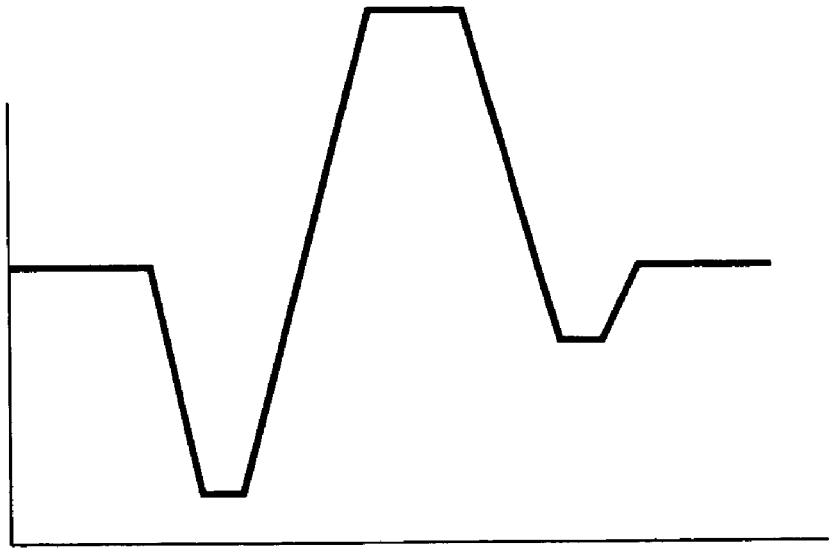
FIG. 16A shows a drive voltage waveform when the temperature of the ink is low.
Figure 16B:
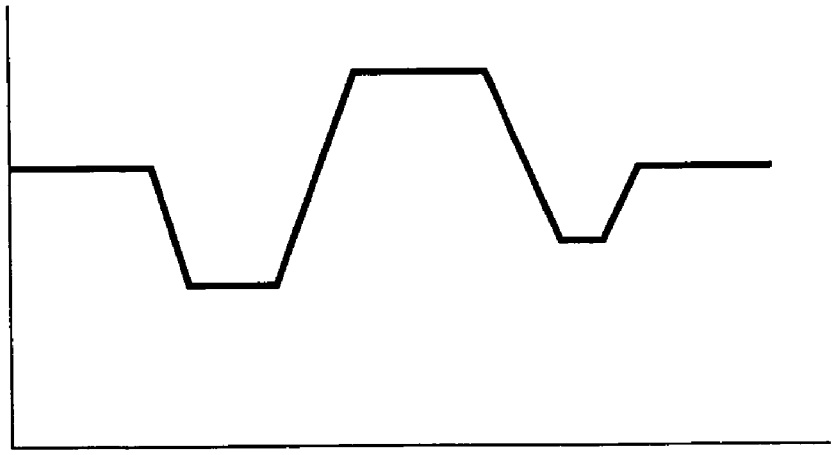
FIG. 16B shows a drive voltage waveform when the temperature of the ink is high.

Next, in step S103, a drive waveform for driving the piezoelectric element 58 is set in accordance with the temperature t detected by the temperature sensor 86. As shown in FIG. 16A, when the temperature detected by the temperature sensor 86 is low, that is, when the viscosity of the ink is high, the amplitude of the drive voltage is increased. As shown in FIG. 16B, when the temperature detected by the temperature sensor 86 is high, that is, when the viscosity of the ink is low, the amplitude of the drive voltage is decreased.

Next, in step S104, the drive signal is transmitted from the drive ICs 80 to the piezoelectric elements 58, and the printing operation is executed.

Figure 17:
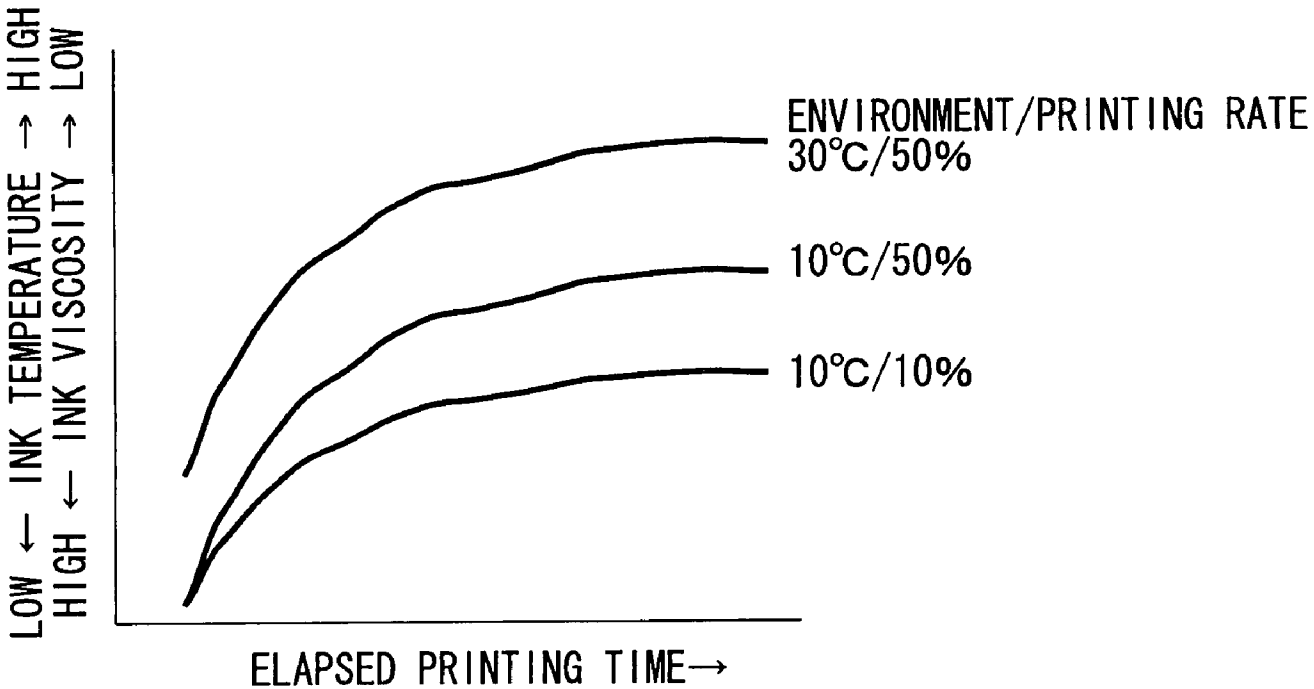
FIG. 17 is a graph showing relationships of the printing time, ink temperature, viscosity of the ink, environment, and printing rate.

Here, as shown in the graph of FIG. 17, the viscosity of the ink changes due to elapsed time for printing, together with the printing rate, and environment. Thus, in the present embodiment, ink discharge is stabilized by executing the printing operation under conditions according to the viscosity of the ink, so that image quality is improved.

Next, in step S105, it is determined whether printing is continuing or not, and if the result is yes, the process proceeds to step S106. If the result is no, the process proceeds to step S110. In step S106, it is determined whether the temperature t of the heat-receiving block 84 detected by the temperature sensor 86 is lower than the predetermined temperature T1 or not, and if the answer is yes, the process returns to step S103. If the answer is no, the process proceeds to step S107.

In step S107, it is determined whether the temperature t of the heat-receiving block 84 detected by the temperature sensor 86 is lower than the predetermined temperature T2 or not, and if the answer is yes, the process proceeds to step S108. If the answer is no, the process proceeds to step S109. In step S108, the printing speed is decreased, and the process returns to step S103 so that the printing operation is continued. In step S109, printing is stopped, and the process returns to step S106, whereby the processing routine of steps S106-S109 is repeated. In step S110, transmission of the drive signal to the driver ICs 80 is stopped to stop the printing operation, and the processing routine is completed.

<Third Embodiment>

Figure 18:
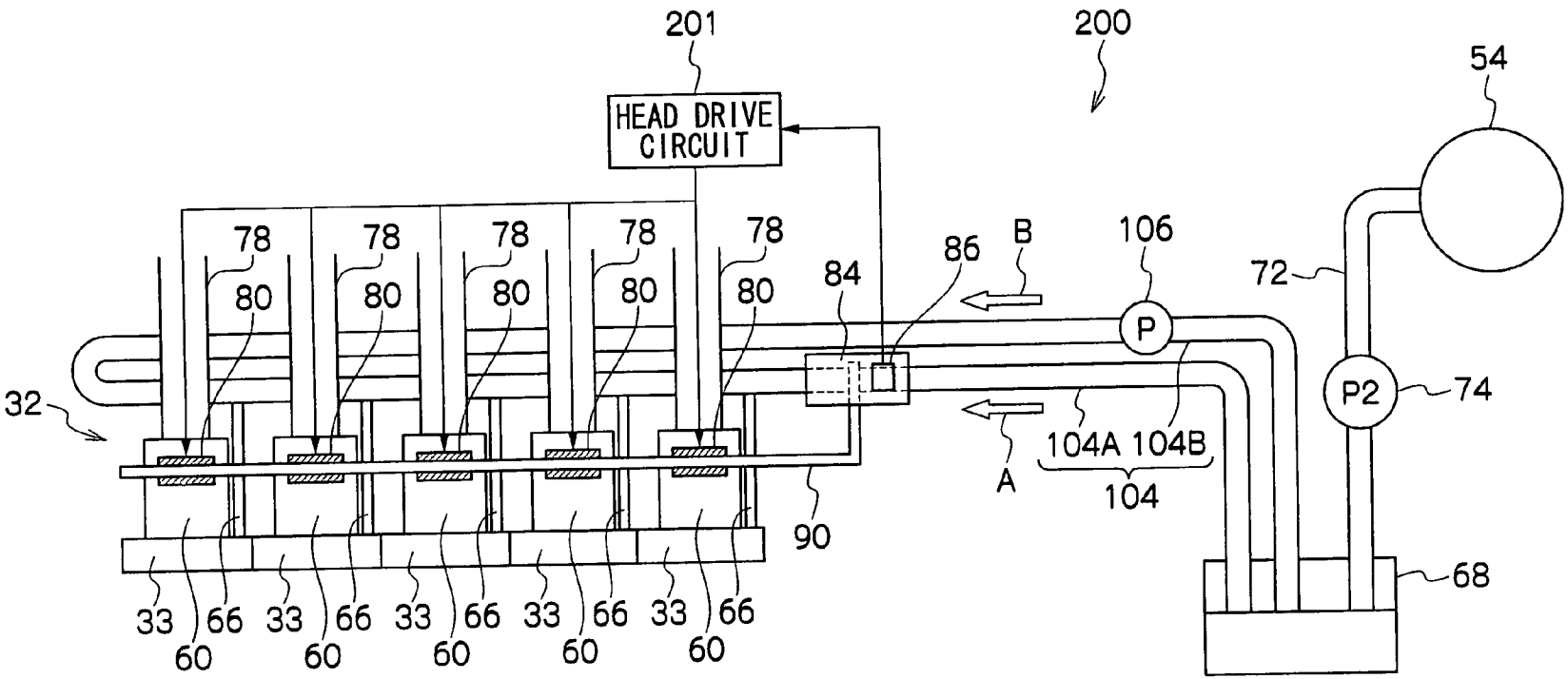
FIG. 18 is a view showing an outline of an ink jet recording head unit of a third embodiment of the invention.
Figure 19:
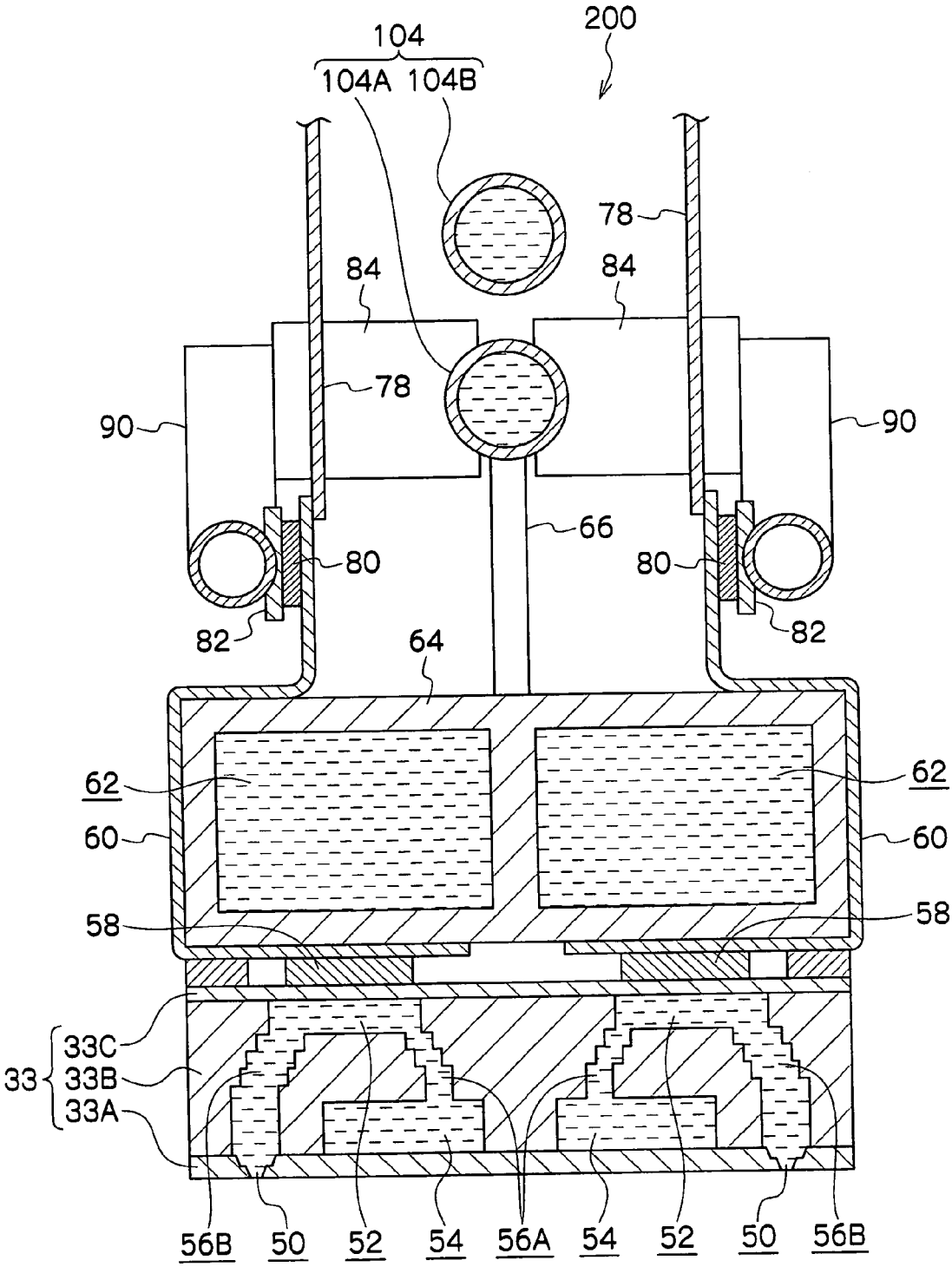
FIG. 19 is a cross-sectional view showing the ink jet recording head unit of the third embodiment of the invention.

As shown in FIGS. 18 and 19, in a head unit 200, a pump 106 provided on an ink circulating path 104 is capable of switching the circulation direction of the ink between a first direction A and a second direction B. The ink circulating path 104 includes a first flow path 104A supplying ink flowing in the first direction A from the sub ink tank 68 to the recording heads 32 and a second flow path 104B supplying ink flowing in the second direction B from the sub ink tank 68 to the recording heads 32. The ink circulating path 104 is formed of metal or resin which has a high thermal conductivity. The heat-receiving block 84 is thermal-transfer coupled with the first flow path 104A. Thus, ink which passes through the first flow path 104A to be supplied to the recording heads 32 or ink which returns to the sub ink tank 68, when passing through the first flow path 104A in a heat-receiving portion of the heat-receiving block 84, is heated so that its viscosity is decreased.

Control in accordance with the detection result of the temperature sensor 86 of a head drive circuit 201 will be described below with reference to the flow chart of FIG. 20.

Upon receiving a print job, a processing routine is started, and proceeds to step S201. Since steps S201-S204 are the same as steps S101-S104 of the processing routine of the second embodiment, description thereof will be omitted, and step S205 and following steps will be described.

In step S205, it is determined whether the printing operation is continued or not, and if the answer is yes, the process proceeds to step S206. If the answer is no, the process proceeds to step S213. In step S206, it is determined whether the temperature detected by the temperature sensor 86 is: lower than a predetermined temperature T4 (>T3, <T1); at the predetermined temperature T4 or higher and lower than a predetermined temperature T5 (>T4, <T1); or it is at the predetermined temperature T5 or higher. If the answer is that it is lower than the predetermined temperature T4, the process proceeds to step S207. And if the answer is that it is at the predetermined temperature T4 or higher and is lower than the predetermined temperature T5, the process returns to step S203. If the answer is that it is at the predetermined temperature T5 or higher, the process proceeds to step S208.

The predetermined temperature T4 is the border-line temperature between a normal and a low temperature of the ink, and the predetermined temperature T5 is a border-line temperature between the normal and a high temperature of the ink. That is, when the ink is at the normal temperature, since the viscosity is maintained at a level at which the ink can be discharged stably, immediately, the process returns to step S203 to prepare for the printing operation.

In step S207, the ink is circulated in the first direction A so as to allow the heat-receiving portion from the heat-receiving block 84 of the first flow path 104A to pass through and to be supplied from the sub ink tank 68 to the recording heads 32.

Here, a supplementary explanation of the temperature of the driver ICs 80 and the ink will be given. Before printing, the driver ICs 80 have already been heated to the minimum dischargeable temperature T3 or higher in steps S201, S202. Thereafter, at the time of printing, since a drive waveform has been applied to a nozzle 50 which discharges the ink and a preparative drive waveform has been applied to a nozzle 50 which does not discharge the ink, the temperatures of the driver ICs 80 are not lower than T3. As shown in FIG. 16A, with respect to the drive waveform of a low temperature time, since the drive voltage is higher than that of a normal temperature time, it is preferred that the ink temperature is allowed to approach from a low temperature to a normal temperature from a viewpoint of power saving. The processing in step S207 is performed in order to increase the ink temperature, utilizing the heat generation of the driver ICs 80. At this time, since there is no need to use an exclusive heating means, extra electrical power is not generated.

Thus, in step S207, since the temperature of a low temperature ink whose temperature is lower than the predetermined temperature T4 is increased by heating so that a drive waveform whose drive voltage is lower can be set in the drive waveform setting in step S203, power saving is possible. When the processing in step S207 is completed, the process returns to step S203.

In step S208, the ink is circulated in the second direction B so as to allow the ink to flow back through from the recording head 32 to the sub ink tank 68 by passing through the first flow path 104A in the heat-receiving portion of the heat-receiving block 84. Thus, ink which has been heated in the heat-receiving portion of the heat-receiving block 84, when its temperature has been increased to the predetermined temperature T5 or higher, can be cooled to a normal temperature by the ink inside the sub ink tank 68, and normal temperature ink can be supplied to the recording heads 32. When the processing in step S208 is completed, the process proceeds to step S209.

Thus, by allowing the circulation direction of the ink to be switched in accordance with the detection result of the temperature sensor 86 of the head drive circuit 201, temperature control for ink becomes possible in which a low temperature ink is heated in step S207 and in which a high temperature ink is cooled in step S208.

In step S209, it is determined whether the temperature t of the heat-receiving block 84 detected by the temperature sensor 86 is lower than the predetermined temperature T1 or not, and if the answer is yes, the process returns to step S203. If the answer is no, the process proceeds to step S210.

In step S210, it is determined whether the temperature t of the heat-receiving block 84 detected by the temperature sensor 86 is lower than the predetermined temperature T2 or not, and if the answer is yes, the process proceeds to step S211. If the answer is no, the process proceeds to step S212. In step S211, the printing speed is decreased, and the process returns to step S203, whereby the printing operation is continued. In step S212, the printing is stopped, and the process returns to step S208, whereby the processing routine of steps S208-S212 is repeated. In step S213, transmission of the drive signal to the driver ICs 80 is stopped, and the printing operation is stopped to complete the processing routine.

In the first through third embodiments, although the invention is exemplified with an ink jet recording apparatus, a liquid droplet discharge head of the invention is not limited to an ink jet recording head but can be applied to a liquid droplet discharge head for various industrial uses in general, such as fabrication of a color filter for a display in which colored ink is discharged onto a polymeric film or a glass, fabrication of bumps for mounting parts in which solder in a melted state is discharged onto a substrate, fabrication of an EL display panel in which an organic EL solution is discharged onto a substrate, or fabrication of bumps for electrical mounting in which solder in a melted state is discharged onto a substrate.

In a liquid droplet discharge head and a liquid droplet discharge apparatus of the present invention, a "recording medium" is an object for recording an image on, and includes a wide range of materials as long a liquid droplet discharge head can discharges droplets thereon. Accordingly, the recording medium not only includes recording paper, OHP sheets, or the like but also includes for example a substrate on which a wiring pattern or the like is formed.

Further, in the first through third embodiments, although the invention is described taking an example of the structure in which plural ink jet recording heads structured as units whose length is shorter than the width of the paper P arranged in the width direction of the paper P, the invention is not limited thereto, and the liquid droplet discharge head of the invention can also be applied to a structure for example in which an ink jet recording head which is shorter than the width of the paper P is moved in the width direction of the paper P.

What is claimed is:

1. A liquid droplet discharge unit comprising:

a plurality of nozzles;

a plurality of pressure chambers in which liquid is filled, each being communicated with at least one of the plurality of nozzles;

a plurality of drive sections each of which changes the volume of one of the plurality of pressure chambers to allow a liquid droplet to be discharged from the nozzle;

a plurality of drive elements, each of which causes one of the plurality of drive sections to be driven;

a heat pipe which is in thermal communication with the plurality of drive elements, and moves heat to one end in an axial direction of the heat pipe;

a heat-receiving member which is in thermal communication with one end portion in the axial direction of the heat pipe to receive heat from the heat pipe; and a tank that stores liquid and a liquid feed path supplying liquid from the tank to the pressure chambers, wherein the heat-receiving member is in thermal communication with the liquid feed path.

2. The liquid droplet discharge unit of claim 1, further comprising a thermal detection section that detects the temperature of the heat-receiving member.

3. The liquid droplet discharge unit of claim 2, further comprising a first control section that stops the driving of the drive section or reduces a driving speed thereof when the temperature detected by the thermal detection section is at a predetermined temperature or higher.

4. The liquid droplet discharge unit of claim 3, further comprising a tank that stores liquid and a liquid feed path supplying liquid from the tank to the pressure chamber, wherein the heat-receiving member is in thermal communication with the liquid feed path.

5. The liquid droplet discharge unit of claim 2, further comprising a tank that stores liquid and a liquid feed path supplying liquid from the tank to the pressure chambers, wherein the heat-receiving member is in thermal communication with the liquid feed path.

6. The liquid droplet discharge unit of claim 1, further comprising a second control section that switches a drive waveform of the drive section in response to the temperature detected by the thermal detection section.

7. The liquid droplet discharge unit of claim 6, wherein a liquid circulating path that circulates liquid between the tank and the pressure chamber is provided as the liquid feed path.

8. The liquid droplet discharge unit of claim 1, wherein a liquid circulating path that circulates liquid between the tank and the pressure chamber is provided as the liquid feed path.

9. The liquid droplet discharge unit of claim 8, further comprising a circulation direction switching section that circulates liquid in a first direction in which liquid is supplied passing through a position at which the liquid receives heat from the heat-receiving member on the liquid circulating path to the pressure chamber when the temperature detected by the thermal detection section is lower than a predetermined first temperature, and which circulates liquid in a second direction that is the opposite direction of the first direction when the temperature detected by the thermal detection section is the same as or higher than a predetermined second temperature.

10. A liquid droplet discharge unit comprising:

a plurality of nozzles;

a plurality of pressure chambers in which liquid is filled, each being communicated with at least one of the plurality of nozzles;

a plurality of drive sections each of which changes the volume of at least one of the plurality of pressure chambers to allow a liquid droplet to be discharged from the nozzle;

a plurality of drive elements, each of which causes one of the plurality of drive sections to be driven;

a heat pipe which is in thermal communication with the plurality of drive elements, and moves heat to one end in an axial direction of the heat pipe;

a heat-receiving member which is in thermal communication with one end portion in the axial direction of the heat pipe, and receives heat from the heat pipe;

a thermal detection section that detects the temperature of the heat-receiving member;

a first control section that stops the drive of the drive section or reduces a speed when the temperature detected by the thermal detection section is at a predetermined temperature or higher;

a tank that stores liquid;

a liquid feed path which is in thermal communication with the heat-receiving member and which supplies liquid from the tank to the pressure chambers; and a second control section that switches a drive waveform of the drive section in response to the temperature detected by the thermal detection section.

11. A liquid droplet discharge apparatus comprising a liquid droplet discharge unit and a transport section, the liquid droplet discharge unit comprising:

a plurality of nozzles;

a plurality of pressure chambers in which liquid is filled, each being communicated with at least one of the plurality of nozzles;

a plurality of drive sections each of which changes the volume of at least one of the plurality of pressure chambers to allow a liquid droplet to be discharged from the nozzle;

a plurality of drive elements, each of. which causes one of the plurality of drive sections to be driven; and a heat pipe which is in thermal communication with the plurality of drive elements to move heat to one end side of an axial direction;

said transport section, which transports a sheet while the sheet is opposed to the nozzles;

wherein the liquid droplet discharge unit further comprises a tank that stores liquid and a liquid feed path which supplies liquid from the tank to the pressure chamber, wherein the heat-receiving member is in thermal communication with the liquid feed path.

12. The liquid droplet discharge apparatus of claim 11, wherein the liquid droplet discharge unit further comprises a heat-receiving member which is in thermal communication with one end portion in the axial direction of the heat pipe and receives heat from the heat pipe.

13. The liquid droplet discharge apparatus of claim 11, wherein the liquid droplet discharge unit further comprises a thermal detection section that detects the temperature of the heat-receiving member.

14. The liquid droplet discharge apparatus of claim 13, wherein the liquid droplet discharge unit further comprises a first control section that stops the driving of the drive section or reduces a driving speed thereof when the temperature detected by the thermal detection section is at a predetermined temperature or higher.

15. The liquid droplet discharge apparatus of claim 11, wherein the liquid droplet discharge unit further comprises a control section that switches a drive waveform of the drive section in response to the temperature detected by the thermal detection section.

16. The liquid droplet discharge apparatus of claim 11, wherein the liquid droplet discharge unit further comprises a circulation direction switching section that circulates liquid in a first direction in which liquid is supplied passing through a position at which the liquid receives heat from the heat-receiving member on the liquid circulating path to the pressure chamber when the temperature detected by the thermal detection section is lower than a predetermined first temperature, and which circulates liquid in a second direction that is the opposite direction of the first direction when the temperature detected by the thermal detection section is higher than a predetermined second temperature.

17. The liquid droplet discharge apparatus of claim 11, wherein the liquid droplet discharge unit further comprises:

a heat-receiving member which is in thermal communication with one end portion in the axial direction of the heat pipe, and receives heat from the heat pipe;

a thermal detection section that detects the temperature of the heat-receiving member;

a first control section that stops the driving of the drive section or reduces a driving speed thereof when the temperature detected by the thermal detection section is at a predetermined temperature or higher;

a tank that stores liquid;

a liquid feed path which is in thermal communication with the heat-receiving member and which supplies liquid from the tank to the pressure chambers; and a second control section that switches a drive waveform of the drive section in response to the temperature detected by the thermal detection section.

* * * * *